US006200229B1

(12) United States Patent
Grace et al.

(10) Patent No.: US 6,200,229 B1
(45) **Date of Patent: *Mar. 13, 2001**

(54) STRIKE FACE OF A GOLF CLUB HEAD WITH INTEGRAL INDICIA AND BORDER

(75) Inventors: Robert M. Grace, Clearwater; Harold M. Parker, St. Petersburg, both of FL (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/309,615

(22) Filed: May 11, 1999

Related U.S. Application Data

(63) Continuation-in-part of application No. 09/001,812, filed on Dec. 31, 1997, now Pat. No. 5,924,939, which is a continuation-in-part of application No. 08/711,974, filed on Sep. 10, 1996, now abandoned.

(51) Int. Cl.[7] ..... A63B 53/04

(52) U.S. Cl. ..... 473/324; 473/330; 473/342; 473/409

(58) Field of Search ..... 473/313, 251, 473/342, 328, 324, 236, 253, 340, 349, 325, 329, 332, 409, 330, 331; 273/DIG. 14; 156/154, 242, 293

(56) References Cited

U.S. PATENT DOCUMENTS 1,562,956 * 11/1925 Guerne .
2,846,228 * 8/1958 Reach .
2,880,002 * 3/1959 Wetty .
3,695,618 * 10/1972 Woolley .
3,749,408 * 7/1973 Mills .
3,836,153 * 9/1974 Dance .
3,989,248 * 11/1976 Campau .
4,679,792 * 7/1987 Straza .
4,801,146 * 1/1989 Honma .
4,804,188 * 2/1989 McKee .
4,809,978 * 3/1989 Yamaguchi .
5,104,457 * 4/1992 Viljoen .
5,332,214 * 7/1994 Tucker .
5,333,861 * 8/1994 Mills .
5,358,249 * 10/1994 Mendralla .
5,362,055 * 11/1994 Rennie .
5,398,929 * 3/1995 Kitaichi .
5,411,264 * 5/1995 Oku .
5,413,333 * 5/1995 Janes .
5,431,396 * 7/1995 Shieh .
5,447,311 * 9/1995 Viollaz .
5,458,332 * 10/1995 Fisher .
5,460,377 * 10/1995 Schmidt .
5,529,543 * 6/1996 Beaumont .
5,575,472 * 11/1996 Magerman .
5,588,923 * 12/1996 Schmidt .
5,605,510 * 2/1997 Schmidt .
5,605,511 * 2/1997 Schmidt .
5,674,132 * 10/1997 Fisher .
5,924,939 * 7/1999 Grace .

* cited by examiner

*Primary Examiner*—Sebastiano Passaniti
(74) *Attorney, Agent, or Firm*—Pennie & Edmonds LLP

(57) ABSTRACT

A golf club head having two layers of differently colored, material. One layer is molded with projections, and the other with corresponding recesses, into which the projections fit and are visible from the front strike face of the insert. In a preferred embodiment the projections include a border surrounding the strike face insert having a color selected in combination with an adhesive to mask the appearance of the adhesive at the strike face.

24 Claims, 7 Drawing Sheets

STRIKE FACE OF A GOLF CLUB HEAD WITH INTEGRAL INDICIA AND BORDER

RELATED APPLICATIONS

This application is a continuation in part of co-pending application Ser. No. 09/001,812, filed Dec. 31, 1997 issued as U.S. Pat. No. 5,924,939 and titled "Golf Club Head With A Strike Face Having A First Insert Within A Second Insert," which is a continuation in part of co-pending application Ser. No. 08/711,974, filed Sep. 10, 1996 now abandoned, and titled "Rubber Composition For Golf Putter Face Insert And Golf Putter Comprising Said Rubber Insert."

BACKGROUND OF THE INVENTION

In recent years, golf club technology has evolved rapidly, with many different types of materials, including wood, composite materials, and various metals, now being used to manufacture golf clubs. Golf ball technology has also evolved from the early balata construction to a variety of new golf balls of different materials and designs, including a popular two-piece construction.

With the advent of new golf balls, golf clubs have evolved to provide a feel and sound to the club when striking the ball, such as a two-piece ball, that emulates the feel and sound of striking a balata ball. Along these lines, golf putter manufacturers have introduced putter inserts designed and marketed to appeal to golfers for their soft feel and sound. However, these putter inserts generally do not allow for logos or other indicia to be practically, and prominently, displayed thereon.

Where the prior art club heads do include inserts with indicia, they are typically formed by employing a transparent layer of insert material covering the indicia. Structures of this type are disclosed, for example, in U.S. Pat. Nos. 5,460,377 and 5,605,510. A problem with prior art insert structures of the type described above is that the strike face of the insert is hard and does not provide a soft feel and sound for good playability, as especially desirable with putters.

SUMMARY OF THE INVENTION

It is an object of the present invention to provide a golf club strike face having an insert constructed of a material providing a soft feel and at the same time permitting the inclusion of a logo or other indicia which is prominently visible on the putter face.

It is a further object to provide a strike face insert and method for applying a strike face insert which is economical and provides for minimized scrap rates in manufacturing.

In accordance with the invention, the golf club and more particularly the face of the club head of a putter is provided with an insert constructed of two layers of differently colored material. One layer contains projections extending into the other layer. The projections on the one layer form a logo, other indicia and/or a border, and are visible at the strike face of the insert. In a preferred embodiment, the one layer is molded with the projections and the second layer is separately molded with recesses for receiving the projections, so that when combined, the two layers fit snugly together. The insert is then adhered to the putter face and the front surface of the second layer of the insert is machined so that the projections of the underlying layer are visible at the machined surface. The projections of the underlying layer are ideally formed as a border around the strike face or as a logo or other indicia, or both, and appears prominently on the putter face, as an integral part of the insert. By selecting an adhesive with a color matching one of the layers, any adhesive which seeps through the seams is effectively masked.

The invention is particularly applicable to inserts made of material which is opaque and which, at the same time, has the physical properties to provide the soft feel and sound, preferred by golfers.

DETAILED DESCRIPTION OF THE INVENTION

The following embodiments of the present invention will be described in the context of golf putters having strike face inserts, although those skilled in the art will recognize that the disclosed method and structure are usable with other golf clubs.

Figure 1:
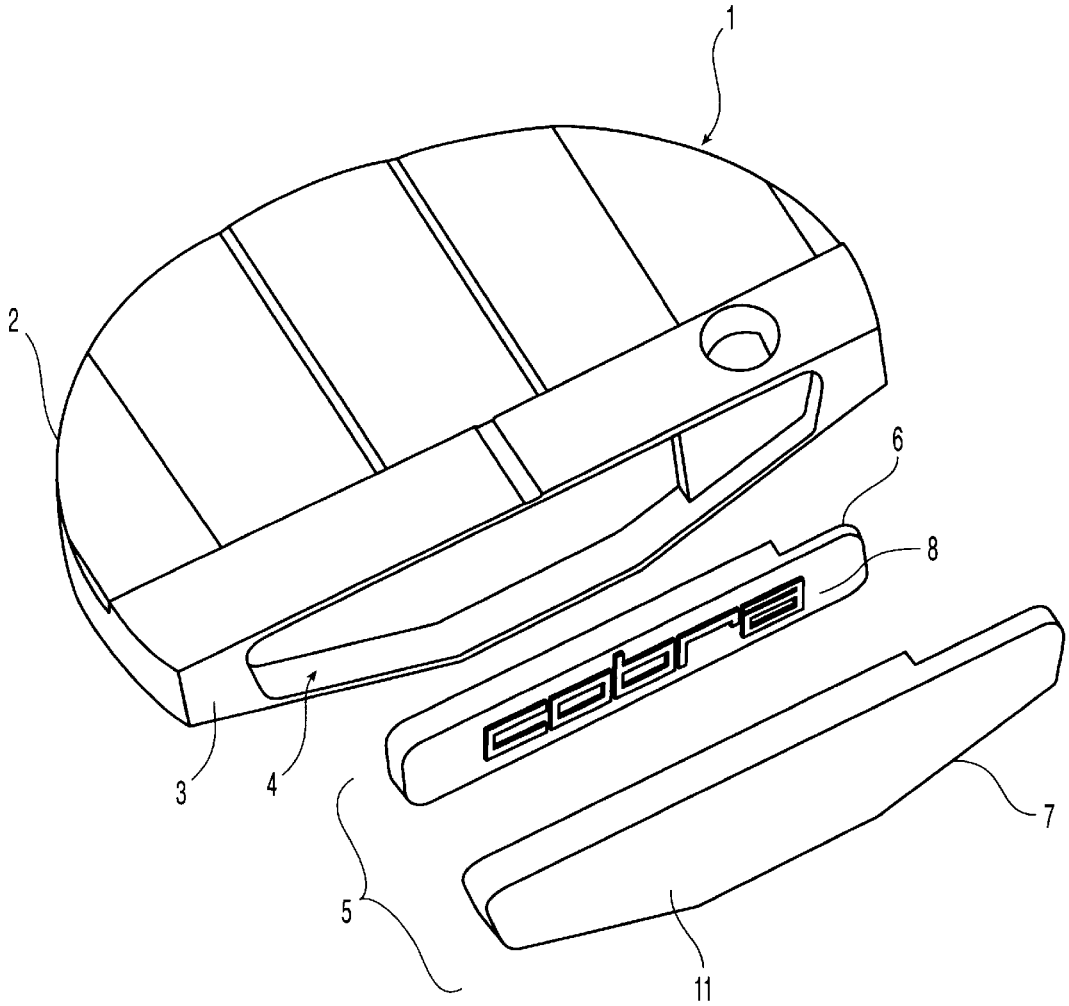
FIG. 1 is an exploded front perspective view a golf club putter head having an insert according to the invention prior to final machining.

As shown in FIG. 1, putter head 1 includes a body 2, having a front strike face 3, a strike face cavity 4, and a strike face insert 5. The strike face insert includes a first layer 6 and a second layer 7. In FIG. 1, the putter head body is shown as having a mallet shape with a particularly shaped insert. It is to be understood, however, that other shapes for the body and insert are usable. For example, the invention may be readily adapted to use in blade putters by a person of ordinary skill in the art based on the teachings contained herein.

In accordance with the teachings of the present invention, the two layers 6 and 7 of the strike face insert are composed of differently colored materials. In a preferred embodiment, the materials are the same except for color, so as to provide for a consistent sound and feel when striking a golf ball. The materials are opaque and of contrasting colors so that logos or other indicia may be displayed on the strike face of the putter. Suitable materials for layers 6 and 7 include, but are not limited to, those disclosed in applicants' co-pending application, Ser. No. 08/711,974, the disclosure of which is incorporated herein by reference. Preferably, the insert material is a thermoset rubber, as for example, one formed of a cured mixture comprising a polymer blend, a metal salt of an unsaturated carboxylic acid, a free radical initiator, and silica.

Figure 2:
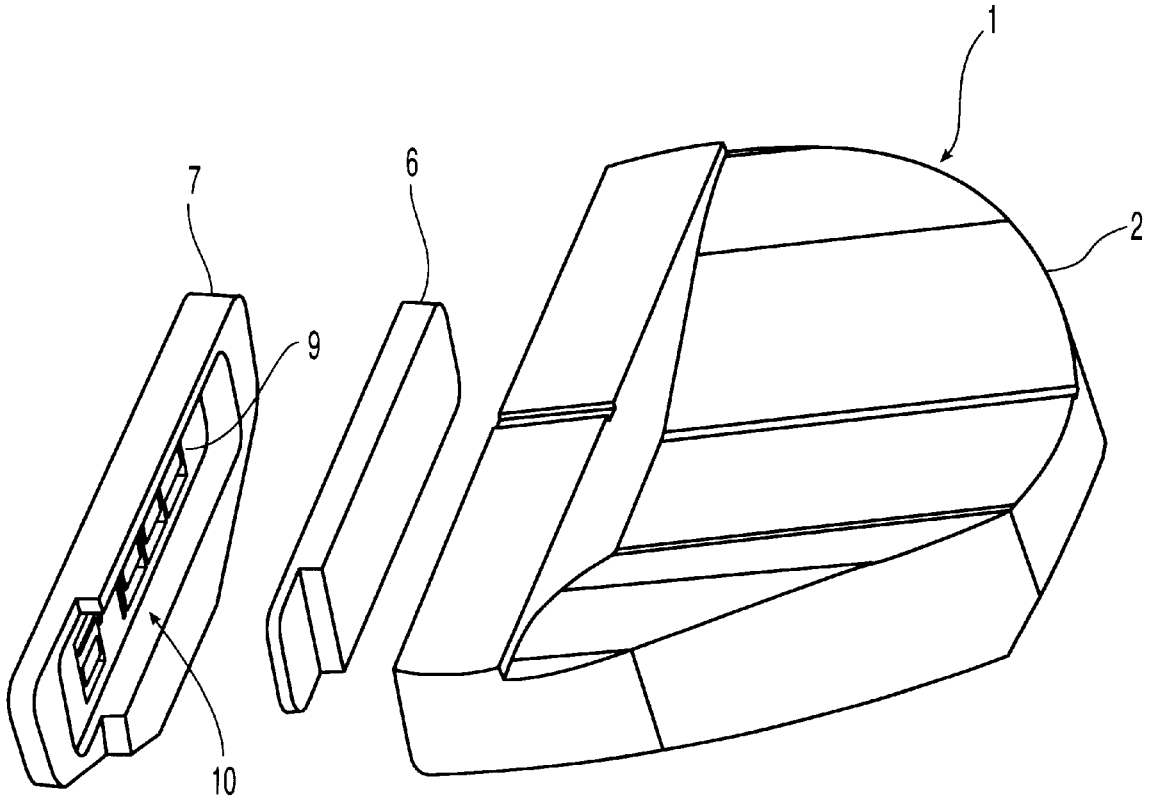
FIG. 2 is an exploded rear perspective view of the putter head of FIG. 1.
Figure 3:
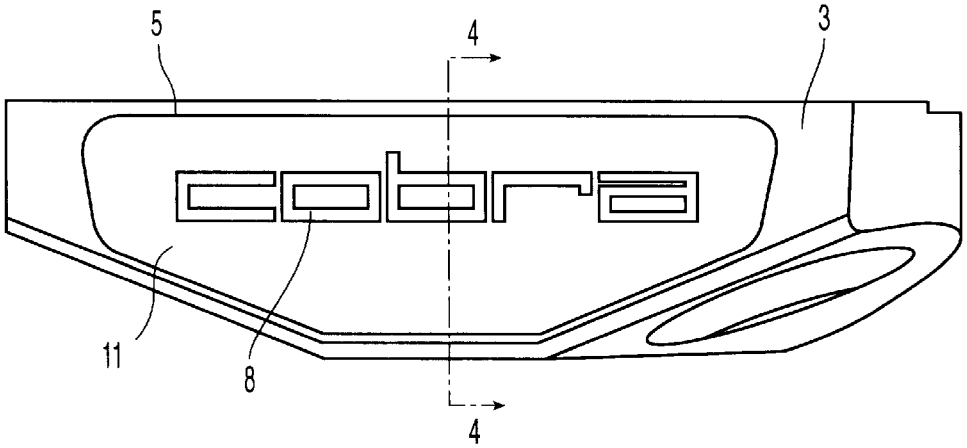
FIG. 3 is a front view of the putter head constructed according to the invention.
Figure 4:
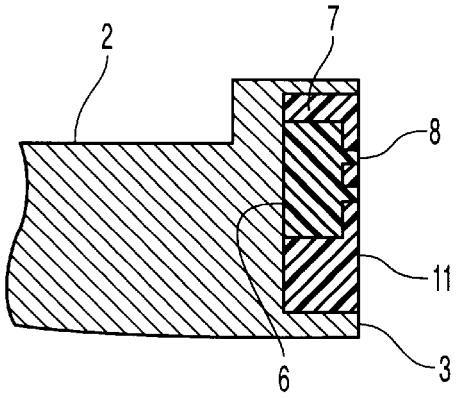
FIG. 4 is a cross-sectional view taken along lines 4—4 of FIG. 3.

In manufacturing the strike face insert 5, first layer 6 is molded with indicia 8, and the second layer 7 with corresponding recesses 9, best seen in FIG. 2. Second layer 7 defines a large recess 10 shaped to receive and hold first layer 6. The recesses 9 are formed within recess 10. The assembled insert layers form the putter strike face insert 5 with a front strike face 11 defined by the front surface of the second layer 7, as shown in FIGS. 3 and 4.

In a preferred embodiment, the first and second layers 6 and 7 are separately molded from uncured stock material. The molding is effected by taking a block of uncured material and curing it in a mold cavity having the desired shape of the insert layer. The same procedure is followed for forming both insert layers. After the insert layers have been formed, they are fit together, preferably with a suitable glue.

Alternatively, one of the insert layers, as for example, the second layer 7 with the recesses 9 and 10 is formed by curing a block of uncured material in an appropriately shaped cavity. This formed insert layer is then used as part of the molding cavity for forming the other insert layer. Thus, the second insert layer is formed while it is simultaneously fit into the first insert layer. This procedure eliminates the need to separately fit and glue the two insert layers together.

Figure 4A:
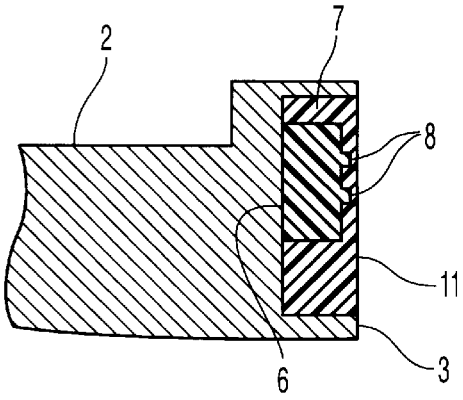
FIG. 4A is a cross-sectional view of an alternative embodiment.

After the first and second layers are molded and fit together, the resulting insert is then fit within the strike face cavity 4, with the front strike face 11 of the insert and the indicia 8 of the first layer 6 extending beyond the strike face 3 of the putter body 2. The front strike face 11 of the insert is then machined until it is flush with the strike face 3 of the club head body (FIG. 4). Enough of the opaque material of the insert layer 7 is removed to expose the indicia 8 of underlying insert layer 6, whereby the projections of contrasting color become visible and distinguishable at the machined front strike face of the insert. As shown in FIG. 4, the machining is done such that the projections (indica 8) are actually at the outer surface of strike face 11. Alternatively, as shown in FIG. 4A, the arrangement of the layers and the machining may be such that a thin portion 13 of second layer 7 remains over projections 8. In other words, the raised indicia 8 is received in the recess 10 of the second layer 7 abutting the thin portion 13 of the recess 10 such that the raised indicia 8 is not exposed on the strike face 11. In this alternative a person of ordinary skill in the art may select the material for second layer 7 such that it would be sufficiently translucent to expose projections 8 through thin portion 13. Once again, a glue may be used to secure assembled insert 5 into strike face cavity 4, although a skilled artisan will recognize that other techniques such as friction fit will work.

Figure 5:
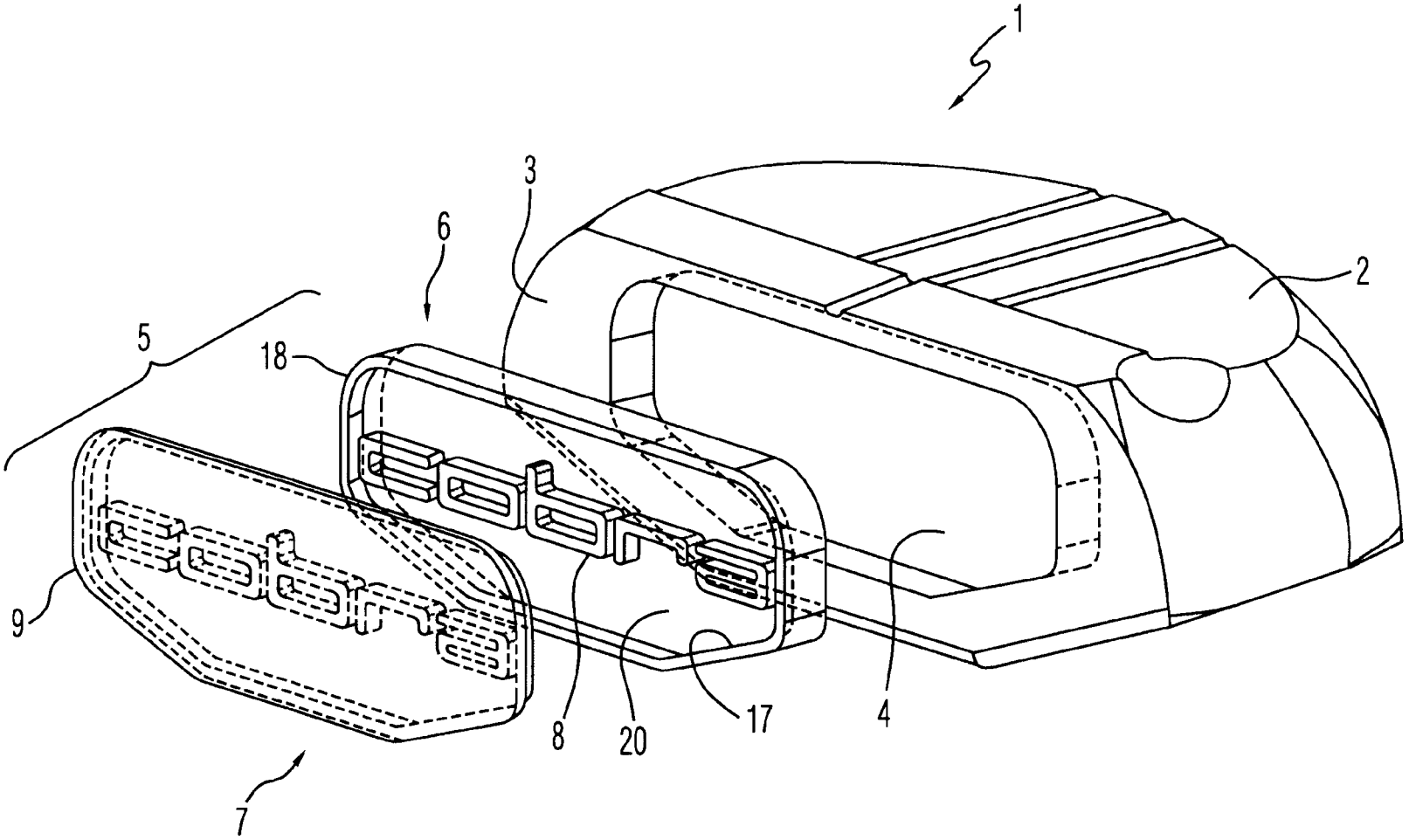
FIG. 5 is a front perspective view of a golf club putter head having an insert according to an alternative embodiment of the present invention.
Figure 6:
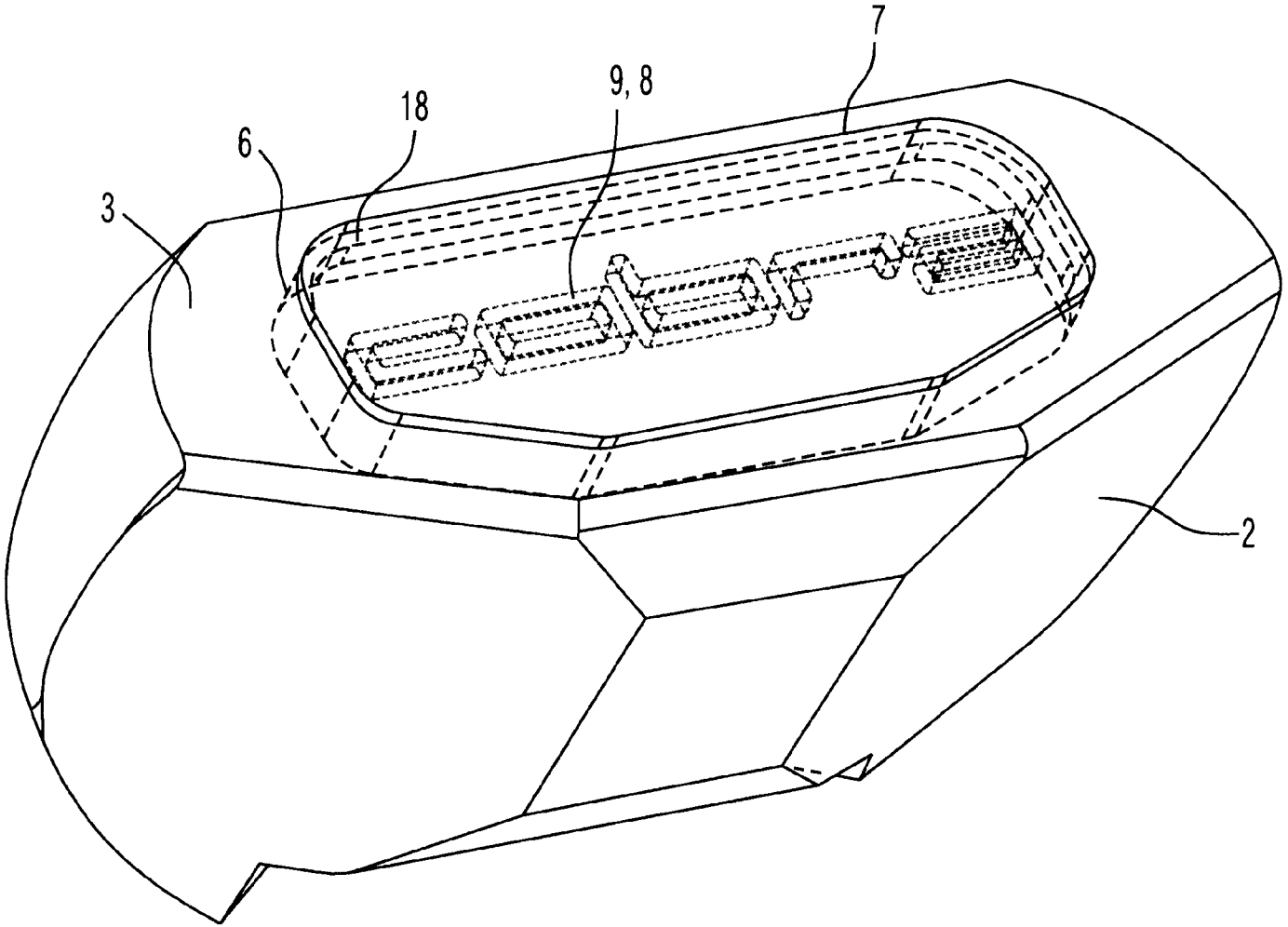
FIG. 6 is a front perspective view of the golf putter head in FIG. 5 with the insert secured into the insert cavity.

FIGS. 5–6 show another alternative embodiment of the present invention. In this alternative embodiment the first layer 6 has extending projections including a raised border 18 around its perimeter and raised indicia 8 located more towards its center. Raised border 18 has an inner periphery 17 that defines a recess 20, in which raised indicia 8 occupy a portion. Additionally, the raised border 18 has an outside periphery 19 that is configured and dimensioned to substantially abut the walls of the strike face cavity 4. Second layer 7 has recesses 9 (shown in phantom), which are mirror images of and configured to receive the raised projections of first layer 6. Preferably, recesses 9 do not extend all the way through layer 7, although a skilled artisan will readily recognize that recesses 9 may extend thorough layer 7 without deviating from the scope of the present invention.

Figure 7:
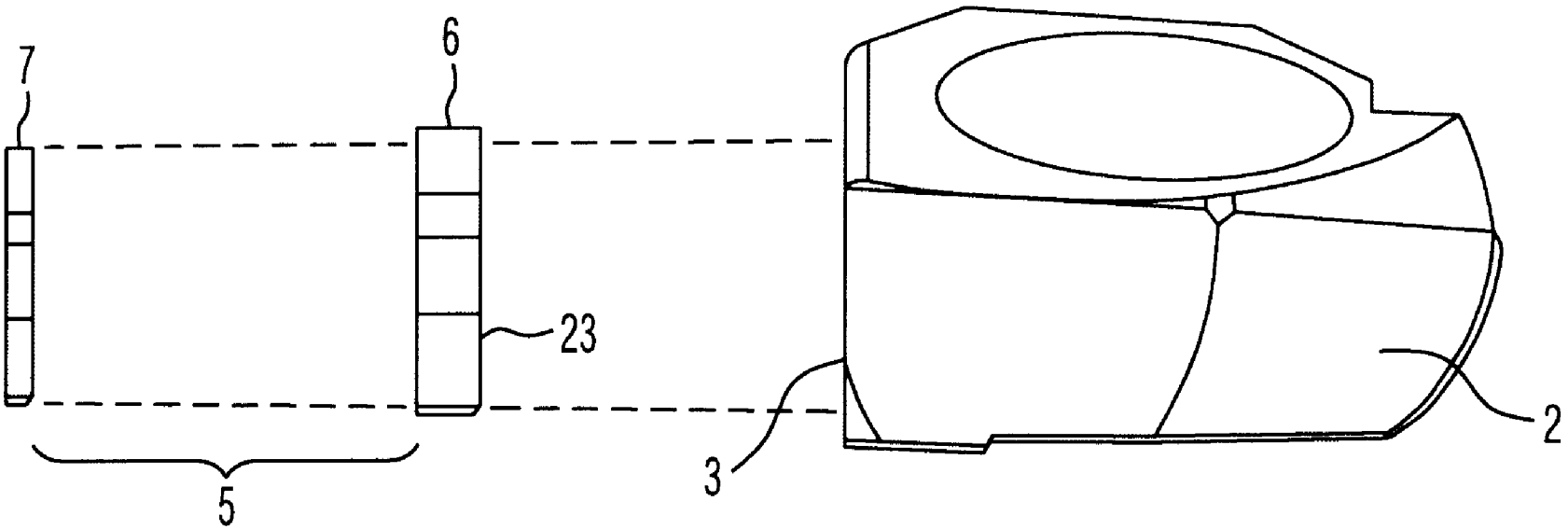
FIG. 7 is an exploded side view of the alternative embodiment shown in FIG. 5.
Figure 9:
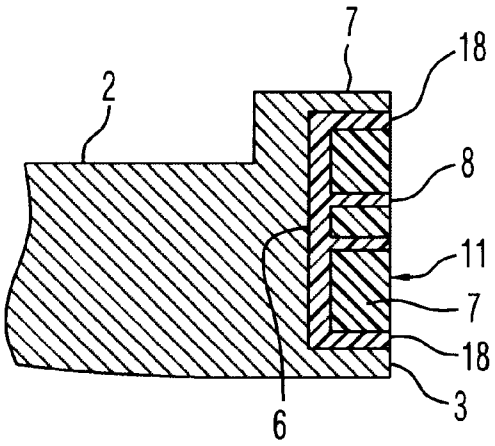
FIG. 9 is a cross-sectional view taken along line 9—9 in FIG. 8.
Figure 8:
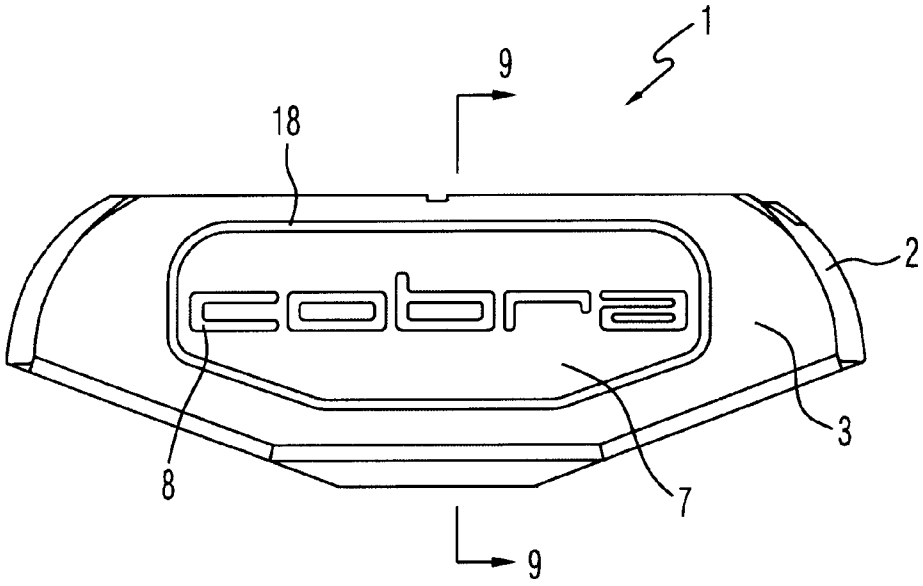
FIG. 8 is a front view of the embodiment of FIG. 5 after machining of the strike face.

Referring to FIG. 6, strike face insert 5 is assembled by inserting second layer 7 into recess 20 such that raised projections 8 and 18 (shown in phantom) mate into recesses 9 (shown in phantom) and such that the edge of second layer 7 substantially abuts the inner periphery 17 of border 18. Preferably an appropriate adhesive is used to bind the two layers together, although the skilled artisan will readily recognize other means to bind the two layers together, such as heat for example, may be used without deviating from the scope of the present invention. In this alternative embodiment the assembled strike face insert has a substantially planar back face 23 (shown in FIG. 7), which allows for the manufacture of a generic strike face insert and a generic strike face cavity for both left handed and right handed club heads, thereby reducing manufacturing costs. The assembled insert is then inserted and secured into strike face cavity 4, such that border 18, raised indicia 8 and a portion of second layer 7 extend beyond front strike face 3 of the club head as shown in FIG. 6. The front face is then machined until indicia 8, border 18, second layer 7 and front strike face 3 are all substantially coplanar to provide visible indica 8 and border 18 on the front of the club head as shown in FIGS. 8 and 9. Alternatively, the indica and border may be visible through a translucent thin portion as shown and described in connection with FIG. 4A.

One advantage of the present invention is that in embodiments using adhesive to secure the two insert layers, the adhesive may be applied all the way to the edges of the layers without concern for the adhesive showing through the seams in the strike face. This arrangement reduces the scrap rate from the manufacturing process, potentially by as much as 85% to 90% compared to embodiments without a border. This advantage may be achieved, for example, by utilizing an adhesive which is approximately the same color as the first layer and border. In an illustrative embodiment, first layer 6 may be black and second layer 7 may be yellow. In this embodiment a suitable adhesive is known in the trade as Black Max® 380 (manufactured by Loctite Corporation), although the skilled artisan will readily recognize that many adhesives with similar properties may be used. Black Max® 380 is a black, rubber toughened ethyl cyonoacrylate adhesive with enhanced resistance to peel and shock loads. Border 18 thus masks the dark colored adhesive that fills gaps, which may result from tolerances between border 18 and second insert layer 7 or the strike face cavity or simply may be squeezed through the seams. It will be readily apparent to the skilled artisan that a differently colored first layer 6 and border 18 can be used to mask a differently colored adhesive.

With the present invention, the putter head is provided with an improved insert strike face that includes permanent, integral indicia that will not wear off. Further, since the material of both insert layers is the same, performance will be the same as with a single insert. Additionally, the provision of the border, whether with or without other indicia, facilitates the adhesive bonding and reduces scrap rate in manufacturing.

What is claimed is:

1. A golf club head, comprising:

a body having a strike surface and a cavity therein, said cavity defined within said strike surface;

a strike face insert having a first layer and a second layer mated together; and at least one projection extending from said first layer, wherein said at least one projection includes a raised border extending around an outside edge of said first layer and surrounding said second layer, and wherein said strike face insert is secured into said cavity such that said at least one projection and said second layer are substantially flush with said strike surface and define at least a portion of said strike surface.

2. The golf club head according to claim 1, wherein an inside periphery of said raised border defines a recess within said first layer configured to receive said second layer, and wherein an outside periphery of said raised border is configured to substantially abut the body within said cavity.

3. The golf club head according to claim 2, wherein said strike face insert is secured into said cavity with an adhesive.

4. The golf club head according to claim 3, wherein the first and second layers are of different colors and the color of said adhesive is substantially the same as the color of said first layer such that the color of said first layer substantially masks any adhesive that lies between said cavity and strike face insert along the strike surface.

5. The golf club head according to claim 1, wherein said at least one projection further includes raised indicia extending from the first layer into the second layer.

6. The golf club head according to claim 5, wherein an inside periphery of said raised border defines a recess within said first layer configured to receive said second layer and into which said indicia extend, and wherein an outside periphery of said raised border is configured to substantially abut said body within said cavity.

7. A golf club head, comprising:

a body having a strike surface and a cavity with a sidewall formed therein;

a strike face insert having a first layer and a second layer mated together disposed in said cavity, wherein said first and second layers are of different colors;

a raised border extending around an outside edge of said first layer, wherein an inside periphery of said raised border defines a recess within said first layer configured to receive said second layer, and wherein an outside periphery of said raised border is configured to substantially abut the side wall of said cavity; and raised indicia formed on said first layer extending into said recess and being received in said second layer, wherein said strike face insert is secured into said cavity such that said indicia and border and said second layer are exposed at the strike surface.

8. The golf club head according to claim 7, wherein said indica, border and second layer are substantially flush with said strike surface and define at least a portion of said strike surface.

9. The golf club head according to claim 7, wherein said strike face insert is secured into said cavity with an adhesive.

10. The golf club head according to claim 9, wherein the color of said adhesive is substantially the same color as said first layer, such that the color of said first layer substantially masks any adhesive that fills between said cavity and the outer periphery of said border at the strike surface.

11. The golf club head according to claim 7, wherein said first layer and said second layer are mated together with an adhesive to form said strike face insert.

12. The golf club head according to claim 11, wherein the color of said adhesive is substantially the same color as the color of one of said layers such that the color of one of said layers substantially masks any adhesive that fills between said first layer and said second layer at the strike surface.

13. The golf club head according to claim 11, wherein the color of said adhesive is substantially the same color as said first layer, such that the color of said first layer substantially masks any adhesive that fills between said first layer and said second layer.

14. The golf club head according to claim 7, wherein said first layer and said second layer are mated together by molding said second layer into said recess of said first layer.

15. The golf club head according to claim 7, wherein said first layer and said second layer are mated together with a heat weld.

16. A golf club head, comprising:

a body having a strike surface and a cavity therein, said cavity defined within said strike surface;

a strike face insert having a first layer and a second layer mated together, wherein said first and second layers are of different colors, said strike face insert being secured in said cavity with both said first and second layers having exposed surfaces that are flush with said strike surface and present at least one seam between said first layer, second layer and body at said strike surface; and an adhesive securing said second layer to at least one of said first layer and said body, said adhesive extending to and being exposed at said at least one seam, said adhesive having a color the same as one of said layers such that said adhesive exposed at said at least one seam blends in appearance with one of said layers.

17. The golf club head according to claim 16, including:

a raised border extending around an outside edge of said first layer, wherein an inside periphery of said raised border defines a recess within said first layer configured and dimensioned to receive said second layer, and wherein an outside periphery of said raised boarder is configured to substantially abut said body in the cavity; and raised indicia extending into said recess, wherein said strike face insert is secured into said cavity such that said indicia, boarder and second layer are substantially flush with said strike surface and define at least a portion of said strike surface.

18. A method of making a golf club head with a strike face insert, said method comprising:

forming a first layer with at least one projection extending therefrom including a border formed around one side of said first layer;

forming a second layer configured to mate with said first layer;

applying adhesive between the first and second layers; and placing the second layer within the border of the first layer;

mating said first and said second layer together, thereby forming said strike face insert;

securing said strike face insert into a cavity in the golf club head;

machining off the strike face including the insert to reveal said at least one projection such that said at least one projection, said second layer and said strike surface are all substantially flush.

19. The method according to claim 18, wherein said applying step comprises applying adhesive up to the edges of at least one said layer.

20. The method according to claim 19, wherein said first layer is a first color, said second layer is a second color and said adhesive is a color substantially the same as said first color, such that said border masks adhesive which moves out between the first and second layers.

21. The method according to claim 18, wherein the step of securing comprises applying adhesive between said first layer and said club head.

22. The method according to claim 18, said at least one projection includes indicia formed within said border.

23. The golf club head according to claim 16, wherein said first layer comprises a raised indicia that extends into said second layer.

24. The golf club head according to claim 23, wherein said second layer comprises a recess having a thin portion to receive said raised indicia of said first layer with said raised indicia abutting said thin portion when said strike face insert is secured into said cavity.

* * * * *